US005651348A

United States Patent [19]

Wall

[11] Patent Number: 5,651,348

[45] Date of Patent: Jul. 29, 1997

[54] FUEL PUMPING APPARATUS

[75] Inventor: Robin Christopher Wall, Rochester, Great Britain

[73] Assignee: Lucas Industries Public Limited Company, Solihull, England

[21] Appl. No.: 666,583

[22] PCT Filed: Jan. 11, 1995

[86] PCT No.: PCT/GB95/00043

§ 371 Date: Jul. 2, 1996

§ 102(e) Date: Jul. 2, 1996

[87] PCT Pub. No.: WO95/19498

PCT Pub. Date: Jul. 20, 1995

[30] Foreign Application Priority Data

Jan. 15, 1994 [GB] United Kingdom ..... 9400719.2

[51] Int. Cl.[6] ..... F02M 37/04

[52] U.S. Cl. ..... 103/502

[58] Field of Search ..... 123/500, 501, 123/502

[56] References Cited

U.S. PATENT DOCUMENTS 4,143,632 3/1979 Kobayashi .

4,593,669 6/1986 Igarashi ..... 123/502

4,753,211 6/1988 Hofer ..... 123/502

FOREIGN PATENT DOCUMENTS 2239963 7/1991 United Kingdom .

WO91/08386 6/1991 WIPO .

*Primary Examiner*—Thomas N. Moulis

*Attorney, Agent, or Firm*—Jacobson, Price, Holman & Stern, PLLC

[57] ABSTRACT

A fuel pumping apparatus of the rotary distributor type has an annular cam ring (12) which is coupled to a tangentially disposed piston (15) slidable in a cylinder (16) formed in a body part (10). The body is formed from light alloy and the piston from steel. The piston is provided with a blind recess (28) at one end and a steel spigot (19) is slidable within the recess. The blind end of the recess communicates with the adjacent end of the cylinder (16) through a restricted passage (23) and a non-return valve (26). Fuel at a varying pressure is applied to the one end of the cylinder to vary the setting of the cam ring.

5 Claims, 2 Drawing Sheets

FUEL PUMPING APPARATUS

Figure 1:
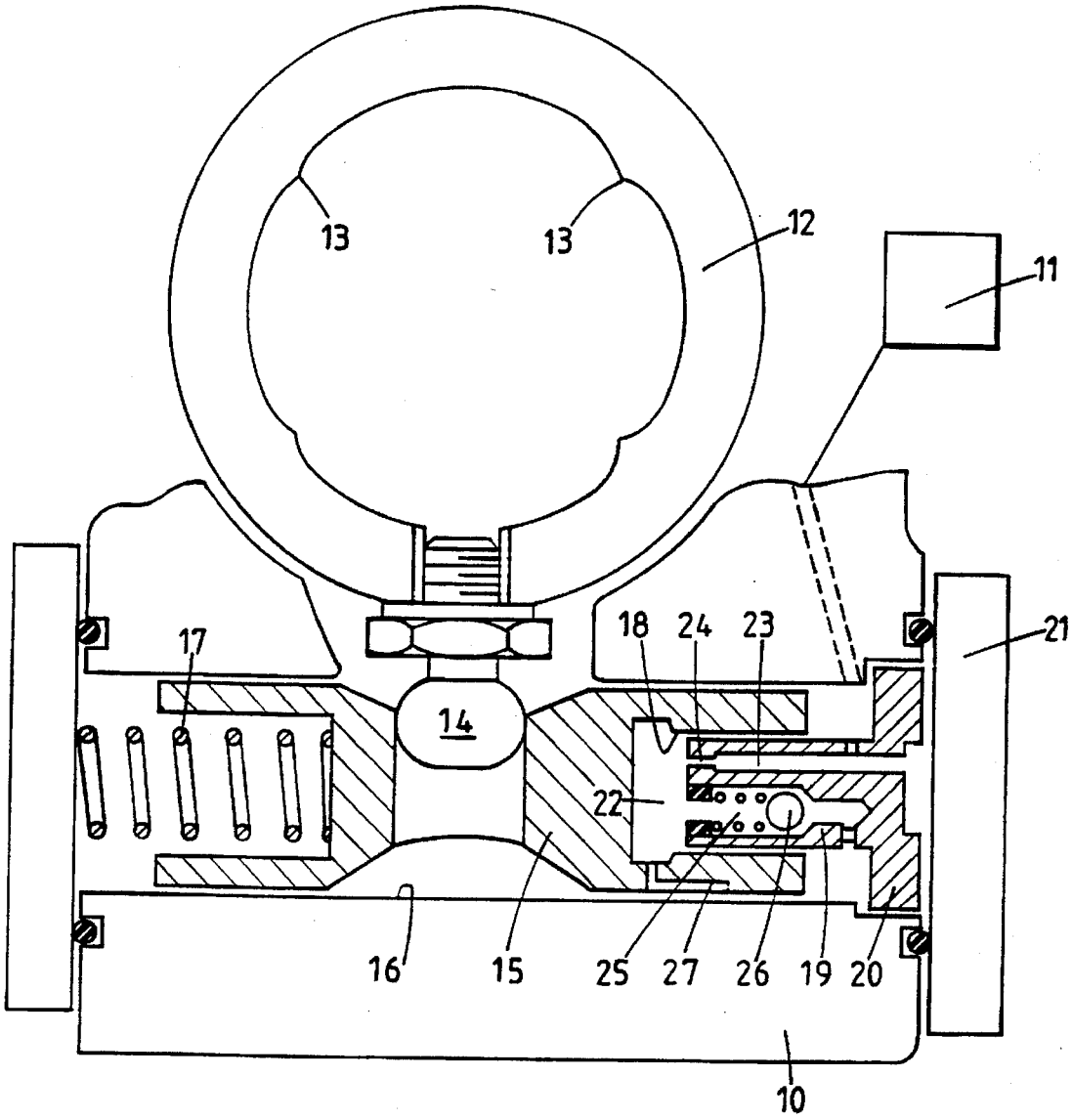

This invention relates to a fuel pumping apparatus for supplying fuel to an internal combustion engine and comprising a high pressure pump including a reciprocable pump element, a cam mechanism operable to actuate the pump element in timed relationship with the associated engine and a fluid pressure operable piston coupled to the cam mechanism, the piston being mounted in a cylinder and acting to vary the timing of fuel delivery to the associated engine in accordance with the pressure of fluid in one end of the cylinder.

In one form of such an apparatus the pump element is in the form of a pair of pumping plungers mounted in a radial bore formed in a rotary part of the pump. The rotary part is driven in timed relationship with the associated engine and at their outer ends the plungers engage cam followers respectively which in turn can engage cam lobes formed on the internal peripheral surface of a cam ring which is mounted for angular adjustment about the axis of rotation of said part. The piston and the cylinder are tangentially disposed relative to the cam ring and are mounted in a body part of the apparatus with the piston defining a recess intermediate its ends and into which extends a peg extending radially from and mounted on the cam ring. The piston is spring loaded in the direction of rotation of the aforesaid part so as to move the piston and cam ring in the timing retard direction and is movable in the opposite direction against the action of the spring, by fluid under pressure which is admitted into the cylinder.

During the operation of the pump the cam ring is subjected to reaction forces particularly when the cam followers engage the leading flanks of the cam lobes. This reaction force is resisted by the creation of an hydraulic lock in the cylinder. The apparatus is required to function over a wide temperature range and it has been the practice to provide an anodised aluminium piston in a bore formed in an aluminium body. This overcomes the problem of differential expansion so that the working clearance between the piston and the wall of the bore forming the cylinder, remains more or less constant over the temperature range. With such an arrangement the piston has to be provided with a steel or like insert for engagement by the peg in order to ensure an adequate surface life. If a steel piston is utilised in the bore so as to overcome the need for the special insert, the working clearance varies with temperature and since the components have to be machined to provide the correct working clearance at the lowest temperature of the temperature range, the working clearance increases as the temperature increases. This leads to increased leakage of liquid along the working clearance so that the hydraulic lock becomes less effective, and it also allows the piston to tilt in the bore under the action of the hydraulic and mechanical loading.

The object of the present invention is to provide an apparatus in an improved form.

According to the invention in an apparatus of the kind specified the piston at said one end of the cylinder defines a blind recess in which is slidably mounted a spigot extending inwardly from an end closure of the cylinder, said spigot and the piston being formed from materials having the same or similar coefficients of expansion, the spigot and the recess defining a working chamber, valve means through which fluid can flow into said working chamber from said one end of the cylinder when the piston is moved away therefrom and restricted passage means through which fluid can flow out of said working chamber as the piston moves towards said one end of the cylinder.

Figure 2:
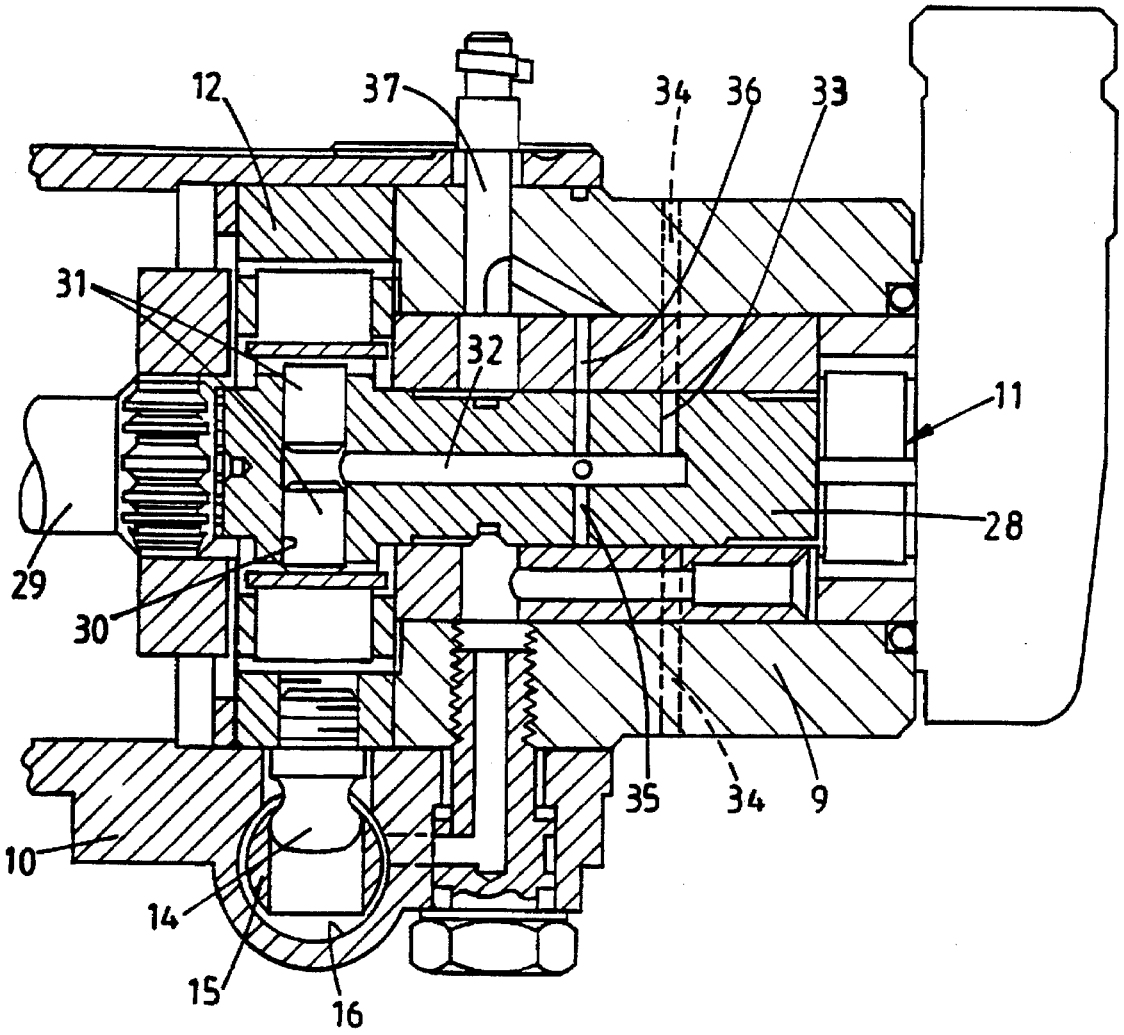

An example of a fuel pumping apparatus in accordance with the invention will now be described with reference to the accompanying drawings in which:

FIG. 1 shows a part sectioned section through a part of a pumping apparatus incorporating the invention, and FIG. 2 shows to a smaller scale a sectional side elevation of the remaining part of the apparatus.

Referring to the drawings the apparatus includes a body 10 which is formed from aluminium or a light alloy. The body 10 forms part of or as shown, is secured to a main body 9 which houses a rotary part in the form of a rotary cylindrical distributor member 28 which is coupled to an engine driven drive shaft 29. Formed in the distributor member is a transversely extending bore 30 in which is mounted a pair of pumping plungers 31. The bore intermediate the plungers defines a pumping chamber which by way of an axial passage 32 and a delivery passage 33, is brought into communication in turn, with outlet ports 34 formed in the body 9, the outlets in use being connected to the injection nozzles respectively of the associated engine. The pumping chamber also communicates with inlet passages 35 in the distributor member, which register in turn intermediate the fuel delivery periods with a fuel inlet port 36. The inlet port is connected by way of an angularly adjustable throttle member 37 to a source of fuel under pressure this source being indicated at 11 in the drawing and conveniently being a vane pump the rotary part of which is coupled to the distributor member 28. At their outer ends the plungers 31 are engaged by cam followers respectively, each cam follower incorporating a roller which can engage with the internal peripheral surface of an annular cam ring 12 which is mounted in the body 10 for angular adjustment about the axis of rotation of the distributor member. Formed on the internal peripheral surface of the cam ring are a plurality of diametrically disposed cam lobes 13 which impart inward movement to the plungers 13 as the distributor member rotates. The inward movement of the plungers displaces fuel from the pumping chamber to one of the aforesaid outlets 34 and the amount of fuel which is supplied is determined by the setting of the throttle member.

The cam ring is movable angularly to vary the timing of fuel delivery and for this purpose it is coupled by means of a peg which has an enlarged head 14, to a piston 15 which is slidable within a cylinder 16 formed in the body. The axis of the piston and the cylinder is tangential to the cam ring.

The piston is biased by means of a spring 17 towards one end of the cylinder, the direction of movement of the piston under the action of the spring being in the direction of rotation of the distributor member 28. The piston is movable in the opposite direction by admitting fluid to the other end of the cylinder conveniently from the low pressure pump 11. The piston is formed in the particular example, from steel and the working clearance between the piston and the wall of the cylinder 16 is such that it is correct at the lowest temperature of the intended working temperature range of the apparatus.

In the end of the piston 15 at said one end of the cylinder 16 there is formed a cylindrical recess 18 and extending into the recess is a spigot 19 which is integrally formed with a plate 20 which is retained in the particular example, in a pocket defined at the end of the cylinder by means of a step formed in the cylinder 16 and an end closure 21. The plate 20 is such in relation to the size of the pocket that it can undergo limited axial and transverse movement for the purpose of alignment. The spigot and the piston are formed from the same material so that the working clearance between the wall of the recess 18 and the surface of the spigot remains substantially constant over the temperature range.

The spigot and the inner end of the recess form a working chamber 22 which is connected through two paths to the one end of the cylinder 16. The first path comprises a passage 23 incorporating a restrictor 24 and the second path comprises a passage 25 in which is mounted a non-return valve 26, the non-return valve being positioned so as to prevent flow of fuel from the working chamber to the one end of the cylinder. In addition, the one end of the cylinder is connected to the low pressure pump 11 and in operation, as the output pressure of the low pressure pump increases with increasing engine speed, the piston 15 will be moved against the action of the spring 17 to advance the timing of fuel delivery. During such movement the one way valve 26 will open to permit fuel flow into the working chamber 22. As the engine speed decreases and the output pressure of the low pressure pump falls, the spring 17 will urge the piston towards the one end of the cylinder and fuel flow out of the working chamber will take place through the passage 23 at a rate controlled by the restrictor 24.

When the pump is in operation, and in particular when the rollers engage the leading flanks of the cam lobes 13 the cam ring 12 will experience a reaction force tending to move the piston 15 towards the one end of the cylinder. This movement is restricted by the creation of an hydraulic lock in the working chamber 22 due to the closure of the valve 26, so that the piston will be held against any appreciable movement due to cam reaction. The working clearance between the spigot and the wall of the recess 18 remains constant throughout the working temperature range of the apparatus, and therefore the hydraulic lock is substantially unaffected. There will be increased leakage as the temperature increases, between the wall of the piston 15 and the bore 16 but so long as the leakage is not so excessive as to materially reduce the output pressure of the low pressure pump, the apparatus will function as described.

It will be noted from the drawing that the head 14 is offset from the axis of the piston 15. This is in order to reduce the necessary excursion of the piston for a given angular movement of the cam ring and also to facilitate assembly. It does mean however that when the reaction force is imparted to the cam ring the piston will tilt slightly in the cylinder and since the piston is formed from steel in the example and the body from aluminium, there could be excessive wear of the contacting surfaces. This tilting force however is partly resisted by the provision of the spigot since this will be urged into positive engagement with the end closure 21 by the pressure generated by the cam reaction forces, in the working chamber 22.

In order to further balance the tilting force, there can be provided on the piston a small recess 27 substantially diametrically opposite the cam ring, the recess 27 communicating with the working chamber 22. The effect of the pressure in the recess 27 is to counteract the tilting force imposed on the piston.

A further advantage of the construction is the fact that the valve 26 and the restrictor 24 are housed in the spigot close to the working chamber 22 and thereby the volume of fuel which is subject to the high pressure is kept to a minimum.

I claim:

1. A fuel pumping apparatus for supplying fuel to an internal combustion engine and comprising a high pressure pump including a reciprocable pump element (31) a cam mechanism (12, 13) operable to actuate the pump element in timed relationship with the associated engine, a fluid pressure operable piston (15) coupled to the cam mechanism, the piston being mounted in a cylinder (16) and acting to vary the timing of fuel delivery to the associated engine in accordance with the pressure of fluid in one end of the cylinder (16) characterised in that the piston (15) at said one end of the cylinder (16) defines a blind recess (18) in which is slidably mounted a spigot (19) extending inwardly from an end closure (21) of the cylinder, said spigot and said piston being formed from materials having the same or similar coefficients of expansion, the spigot (19) and the recess (18) defining a working chamber (22), valve means (26) through which fluid can flow into the working chamber from said one end of the cylinder when the piston (15) is moved away from said one end of the cylinder and restricted passage means (23, 24) through which fluid can flow out of the working chamber as the piston moves towards said one end of the cylinder.

2. An apparatus according to claim 1, characterised in that said valve means (26) comprises a non-return valve, the non-return valve and said restricted passage means (23, 24) being formed in the spigot.

3. An apparatus according to claim 1, characterised in that said spigot (19) is integrally formed with an end plate (20) which is loosely located in a recess formed in a surrounding body (10) in which the cylinder is formed, said plate being held within the recess by an end closure (21).

4. An apparatus according to claim 3 in which said piston is formed with a transverse drilling in which is located a head (14) formed on a peg secured to a cam ring (12) mounted for angular movement about its axis, the head engaging the wall of the drilling at a position offset from the axis of movement of the piston (15).

5. An apparatus according to claim 4, characterised by a recess (27) defined in the wall of the piston, said recess communicating with said working chamber (22) to minimise tilting of the piston within the cylinder.

* * * * *